US007261855B2

(12) United States Patent
Troitski et al.

(10) Patent No.: US 7,261,855 B2
(45) Date of Patent: Aug. 28, 2007

(54) METHOD AND SYSTEM FOR MANUFACTURING OF COMPLEX SHAPE PARTS FROM POWDER MATERIALS BY HOT ISOSTATIC PRESSING WITH CONTROLLED PRESSURE INSIDE THE TOOLING AND PROVIDING THE SHAPE OF THE PART BY MULTI-LAYER INSERTS

(75) Inventors: Igor Troitski, 853 Arrowhead Trail, Henderson, NV (US) 89015; Roman Haykin, Buena Park, CA (US); Eugene Kratt, Anaheim, CA (US); Evgeny Khomiakov, Anaheim, CA (US); Dmitry Seliverstov, Anaheim, CA (US); Victor Samarov, Buena Park, CA (US)

(73) Assignee: Igor Troitski, Henderson, NV (US)

( * ) Notice: Subject to any disclaimer, the term of this patent is extended or adjusted under 35 U.S.C. 154(b) by 508 days.

(21) Appl. No.: 10/809,669

(22) Filed: Mar. 26, 2004

(65) Prior Publication Data

US 2005/0214156 A1 Sep. 29, 2005

(51) Int. Cl.
*B22F 3/15* (2006.01)
*B22F 5/10* (2006.01)

(52) U.S. Cl. ..... 419/5; 419/42

(58) Field of Classification Search ..... 419/5, 419/42

See application file for complete search history.

(56) References Cited

U.S. PATENT DOCUMENTS

| | | | | |
|---|---|---|---|---|
| 4,820,484 | A * | 4/1989 | Ekbom | 419/49 |
| 5,269,058 | A * | 12/1993 | Wiggs et al. | 29/889.72 |
| 5,480,468 | A * | 1/1996 | Ritter et al. | 75/228 |
| 5,939,011 | A * | 8/1999 | White et al. | 264/401 |
| 6,048,432 | A * | 4/2000 | Ecer | 156/263 |
| 6,210,633 | B1 * | 4/2001 | Kratt et al. | 419/49 |
| 6,482,533 | B2 * | 11/2002 | Van Daam et al. | 428/553 |

* cited by examiner

*Primary Examiner*—George Wyszomierski

(57) ABSTRACT

Method for manufacturing complex shape parts including parts with cavities from powder materials by Hot Isostatic Pressing (HIP) with controlled pressure inside the HIP tooling and multi-layer inserts including hollow inserts. Controlled pressure inside the HIP tooling is provided by injecting the HIP gas media into the cavities of the hollow inserts.

4 Claims, 5 Drawing Sheets

METHOD AND SYSTEM FOR MANUFACTURING OF COMPLEX SHAPE PARTS FROM POWDER MATERIALS BY HOT ISOSTATIC PRESSING WITH CONTROLLED PRESSURE INSIDE THE TOOLING AND PROVIDING THE SHAPE OF THE PART BY MULTI-LAYER INSERTS

FIELD OF THE INVENTION

The present invention relates to a method and apparatus for producing state of the art parts by Powder Metallurgy technique, and more particularly, by Hot Isostatic Pressing (HIP).

BACKGROUND OF THE INVENTION

There are well known patents disclosing methods and systems for creation of complex shape parts using powder metallurgy techniques.

U.S. Pat. No. 4,820,484 to Ekbom discloses a method in producing a molding of an iron alloy, wherein the molding is produced by hot isostatic pressing of a prealloyed powder, performed at a pressure ranging between 100 and 150 Mpa, and at a temperature ranging between 1230 degree and the 1270 degree C.

U.S. Pat. No. 5,939,011 to White, et al. discloses a method for producing a composite mandrel for use in creating a precise set of surface features inside a hot isostatic pressed (HIP) billet for producing a desired tool uses a composite nickel shell and ceramic interior. A free form fabrication (FFF) or wax positive pattern of the desired tool is made first, after that a layer of nickel is deposited on the surface of the FFF positive pattern to produce a nickel shell which is a negative of the desired tool. The final step in creating the composite mandrel is filling the nickel shell with ceramic material to increase the rigidity of the nickel shell thereby forming a mandrel for use in an HIP process to make the desired tool.

U.S. Pat. No. 6,048,432 to Ecer discloses the process of forming a part from laminae of powders of materials such as metals, ceramics, intermetallics and composites of such materials, that include forming laminae; forming a stack of the laminae characterized as having a configuration from which a part is to be formed; heating the stack to consolidation temperature, and applying pressure to the heated stack to consolidate the laminae in the stack.

U.S. Pat. No. 6,210,633 to Kratt, et al. discloses a novel method of manufacturing articles of a complex shape by subjecting powder material to Hot Isostatic Pressing (HIP). The method involves manufacturing a capsule with at least one insert. The capsule is filled with outgassed powder. Thereafter, the powder in the capsule is subjected to hot isostatic pressing. The capsule is removed to produce a finished article, such as a bladed disk. The thickness of capsule walls is made variable so as to provide substantially unidirectional axial deformation of the powder during the Hot Isostatic Pressing.

U.S. Pat. No. 6,482,533 to Van Daam, et al. discloses an article having a hollow cavity formed therein and a method for forming the same. The article includes a hollow structure having an open end and a body portion that is surrounded by a powdered material. The article is processed in, for example, a hot isostatic pressing operation, to permit a pressurized fluid to consolidate the powdered material. The pressurized fluid is permitted to pass through the open end of the hollow structure and into the body portion to thereby prevent the body portion from collapsing while the powdered material is being consolidated.

The methods and systems disclosed in Patents mentioned above show that configuration and production of the inserts are the most important standard operations in the process of tooling fabrication that finally forms complex shape part during HIP of powder materials. Solid monolithic inserts are used in HIP tooling manufactured according to the disclosed methods and systems. This is acceptable for simple and small shape parts. Inserts for large parts make the tooling to heavy, require special blank fabrication and a lot of machining time to produce tooling. In this case expensive EDM should be used instead of simple turning or milling. Also heavy inserts are less operable for assembling. They require lengthy time for tooling removal by acid pickling. It is especially difficult to remove solid inserts which form practically closed cavities with the limited access of acid during pickling.

All this makes manufacturing of complex shape large size parts in accordance with the methods and systems disclosed laborious, lengthy and expensive. Therefore, it would be highly desirable to have methods and systems for manufacturing of large complex shape parts by HfP by using a tooling of standard material specification which can be manufactured with less labor expenditures and cost and more easily removed by acid pickling. The present invention discloses the method and system for manufacturing of large complex shape parts from the HIP tooling which enables to reduce fabrication time, simplify assembling process and intensity tooling removal by pickling.

SUMMARY

The present invention discloses the method and system for manufacturing of complex shape pars with cavities from powder materials by hot isostatic pressing with controlled pressure inside the tooling and providing the shape of the parts by multi-layer inserts including hollow inserts.

One or more embodiments of the present invention are a method for manufacturing of the inserts for complex shape parts by using multilayer structures. The number of layers is determined by the shape of parts as welt as by simplification of insert fabrication.

Other embodiments of the invention are a method for the control of a pressure inside the HIP hollow tooling by introducing HIP gas media, realized by manufacturing of the HIP tooling element controlling the pressure inside hollow inserts. This method can be realized by three different controlled systems detailed description of which is given.

One and more embodiments of the present invention are systems of manufacturing complex shape parts with cavities from powder materials by HIP with controlled pressure inside the HIP tooling and providing the shape of the part by multi-layer inserts comprising:

- the shaping tool which includes a capsule having the internal shape and dimensions corresponding to the shape and dimensions of the final part;
- multi-layer inserts including hollow inserts providing the shape and dimensions of the cavities in the part;
- powder material;
- HIP tooling element controlling the pressure inside said hollow inserts comprising a vent tube.

Other embodiment is a method for manufacturing complex shape parts including parts with cavities from powder materials by HIP with subsequent simultaneous removal of the outer capsule and inserts by acid pickling provided by the hollow inserts connected to the atmosphere.

DETAILED DESCRIPTION OF THE INVENTION

The purpose of this invention is creating of a methods and systems for manufacturing of large complex shape parts by Hot Isostatic Pressing (HIP) from powder materials.

The creation of a methods and systems includes tooling modeling and design, manufacturing of tooling that external and internal shapes of the said parts during HIP.

One or more embodiments of the present invention are a method for manufacturing of the inserts for complex shape parts by using multi-layer structure. A capsule is manufactured as a can with hollow or solid insets. The number of layers is determined by the shape of the said part as well as by simplification of insert fabrication.

The more complicated is the shape of part the more insert layers is necessary. Optimal thickness of each layer is selected by taking into account possible deformation for thin layers in assembling process on one hand and simplification of layer machining and assembling on the other hand.

EXAMPLE 1

Figure 1:
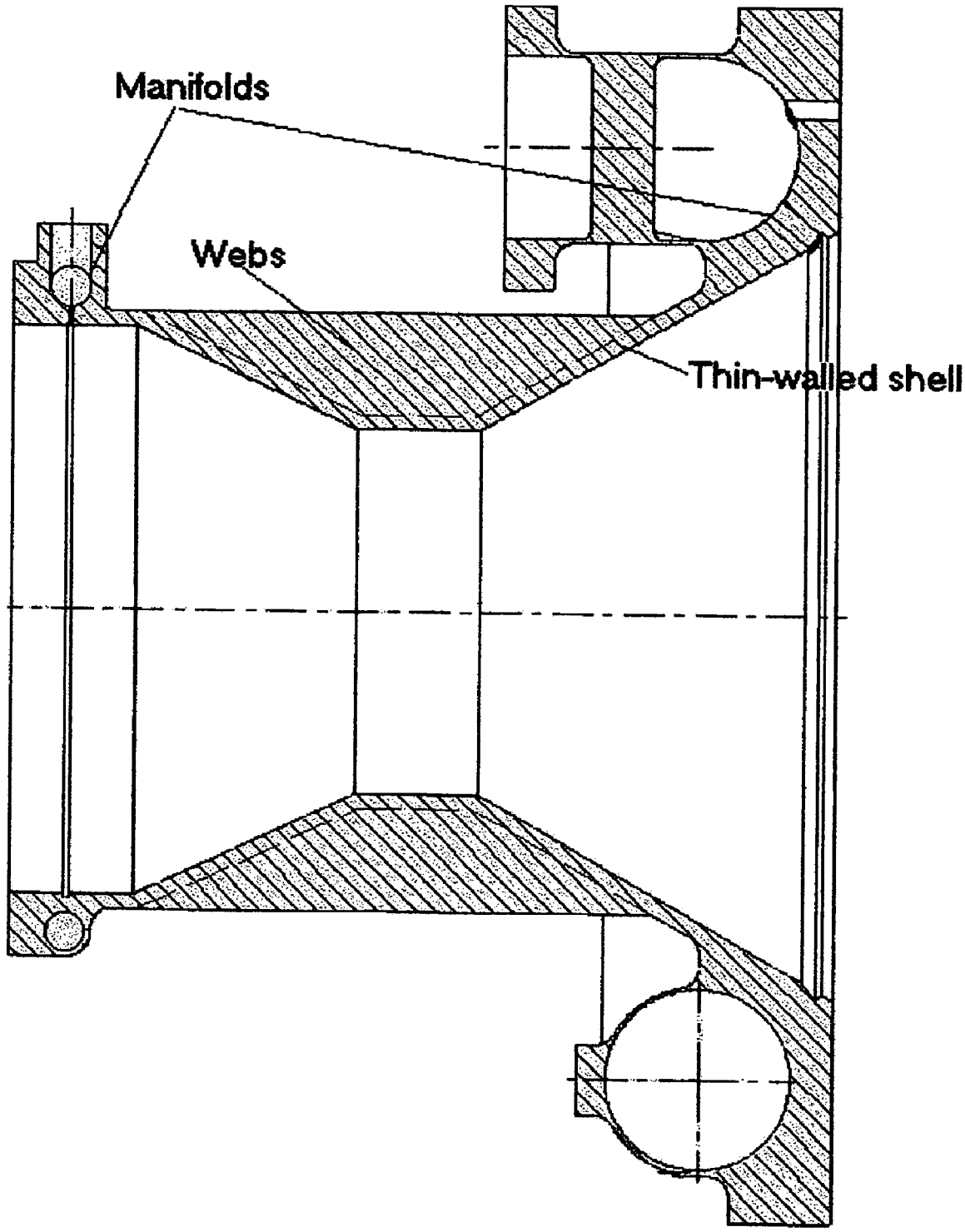
FIG. 1 shows complex shaped large size structural component with cavities and webs.
Figure 2:
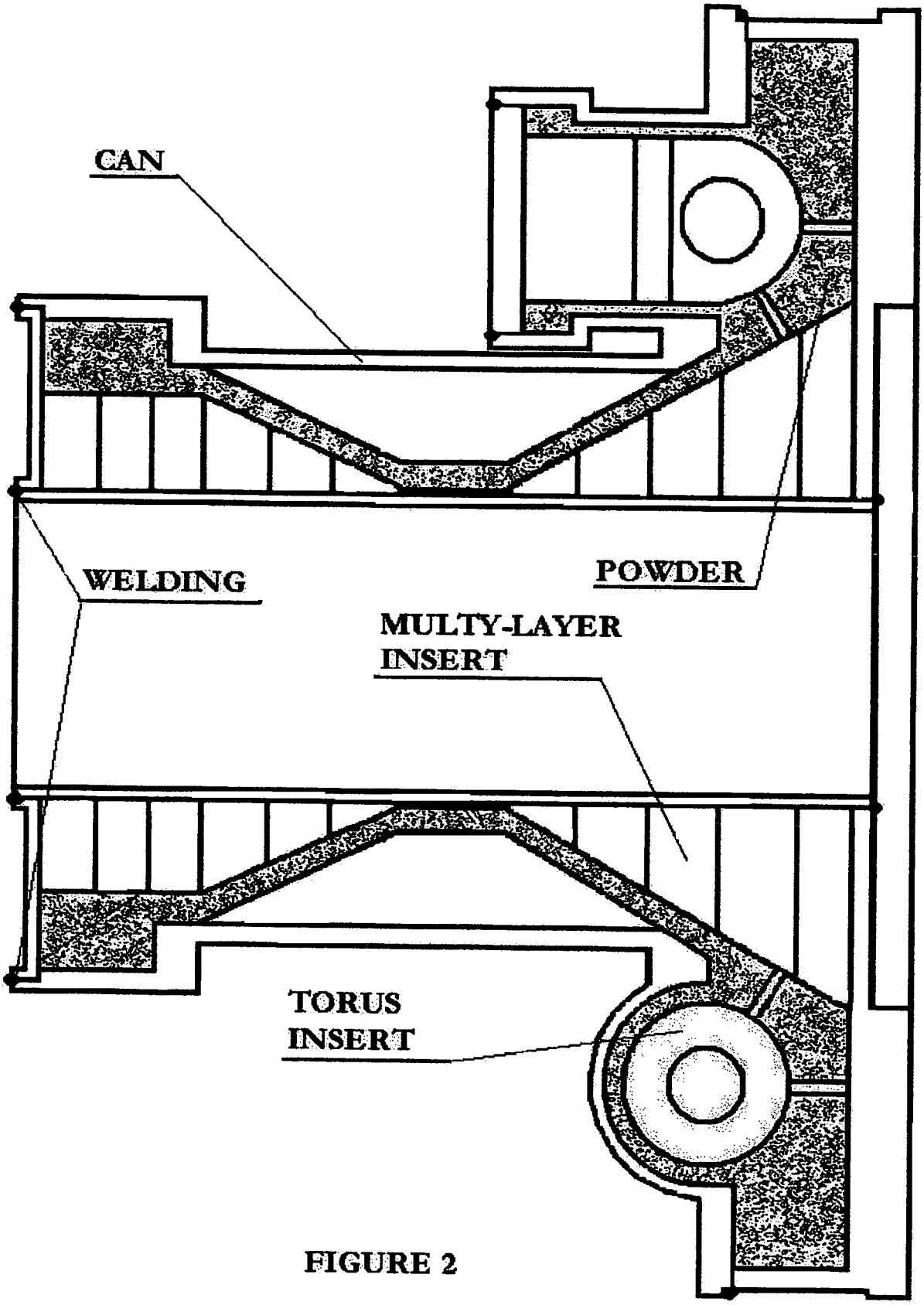
FIG. 2 shows HIP tooling (capsule with inserts) to produce a complex shaped large size component with cavities. The HIP tooling for this part comprised a capsule with the variable wall thickness. It was sectioned into several elements machined from plates and joined together by welding.
Figure 3:
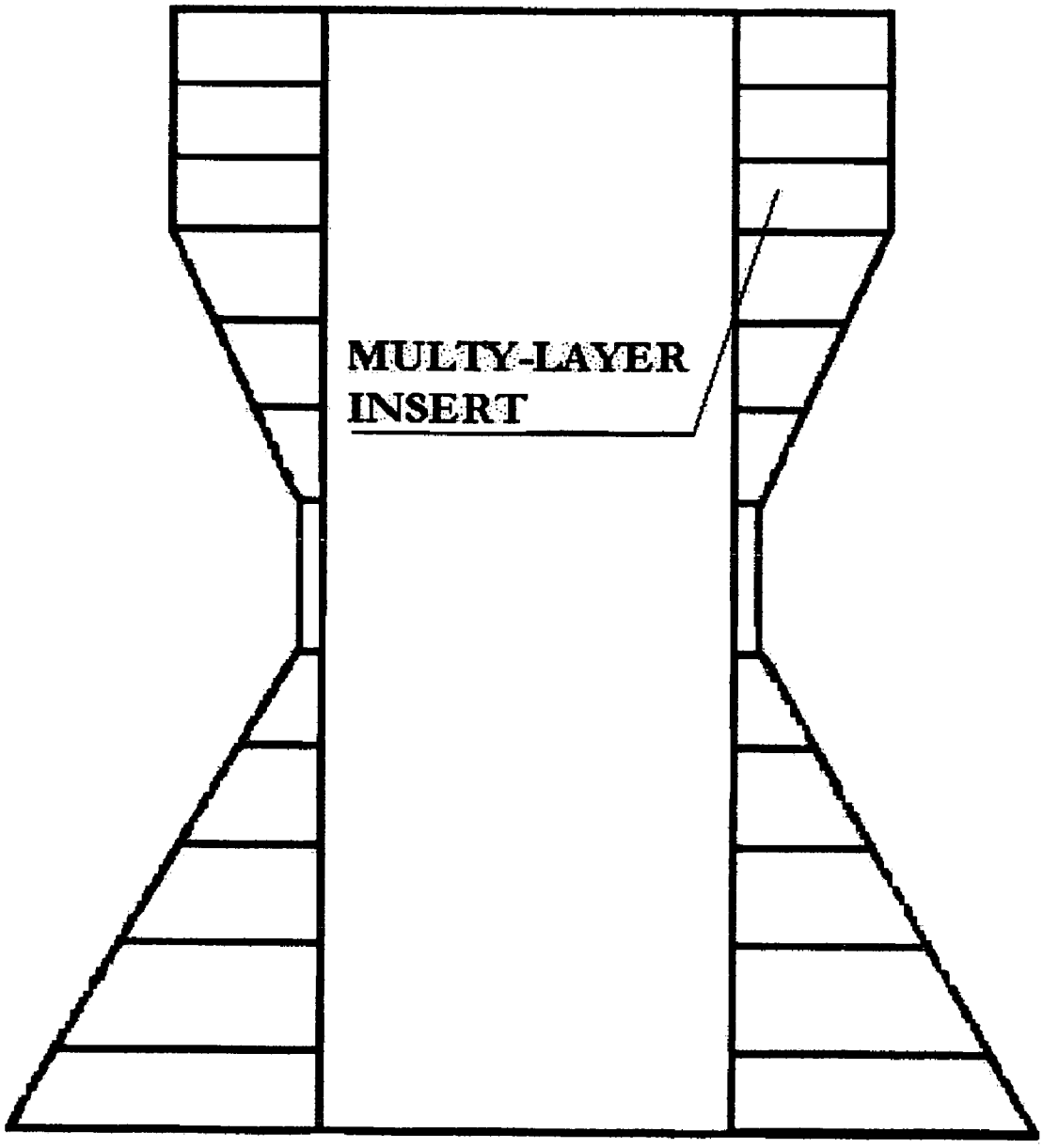
FIG. 3 shows the multi-layered insert of the HIP tooling to provide the hollow complex shape part. Multilayered insert consisted of number of plates with thickness which is 1/10-1/20 of the components height.

FIG. 1 shows complex shape part with 30" in diameter and 20" high. The part comprises a thin walled shell supported by webs and toroidal manifold of 4.5" in diameter. FIG. 2 illustrates a tool for shaping. FIG. 3 shows insert layers, each layer has 1/10-1/20 of component height, 1-2" thick.

Other embodiments of the invention are a method for the control of a pressure inside the HIP hollow tooling by introducing HIP gas media, realized by manufacturing of the HIP tooling element controlling the pressure inside hollow inserts; providing a vent tube connection to the component part controlling the pressure inside hollow inserts; assembling of the said capsule with inserts;

filling the said capsule containing inserts with powder; application of Hot isostatic Pressure to the said capsule with powder; injection of the HIP gas media into cavity of the said capsule and removal of the hollow inserts by acid pickling.

EXAMPLE 2

Figure 4:
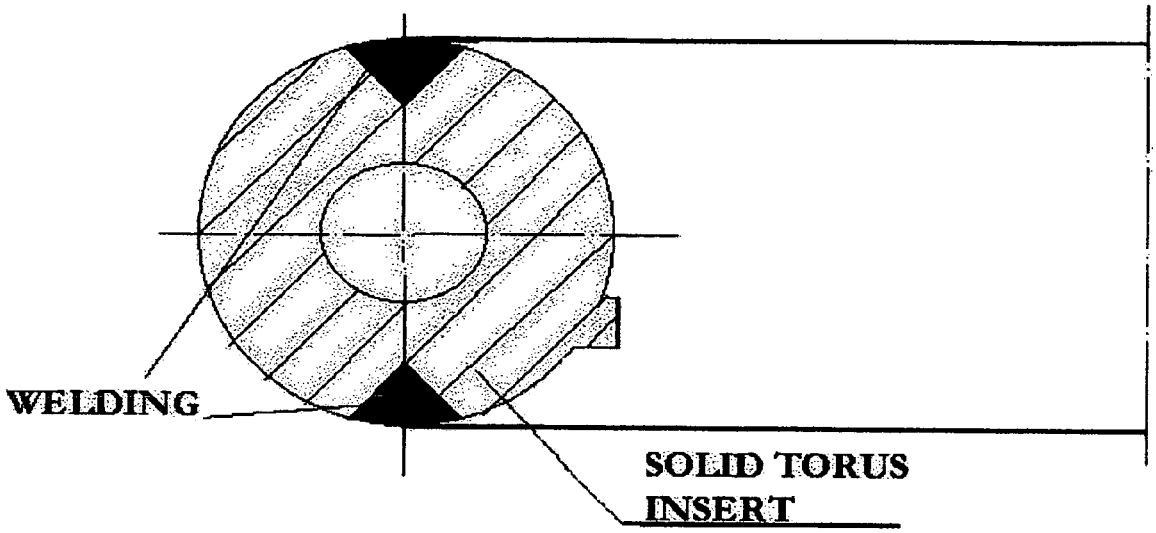
FIG. 4 shows hollow toroidal multi-layer insert to provide toroidal cavities in the component. Hollow inserts were made as toruses consisting of the two layers. Tig welding was used to join the layers.
Figure 5:
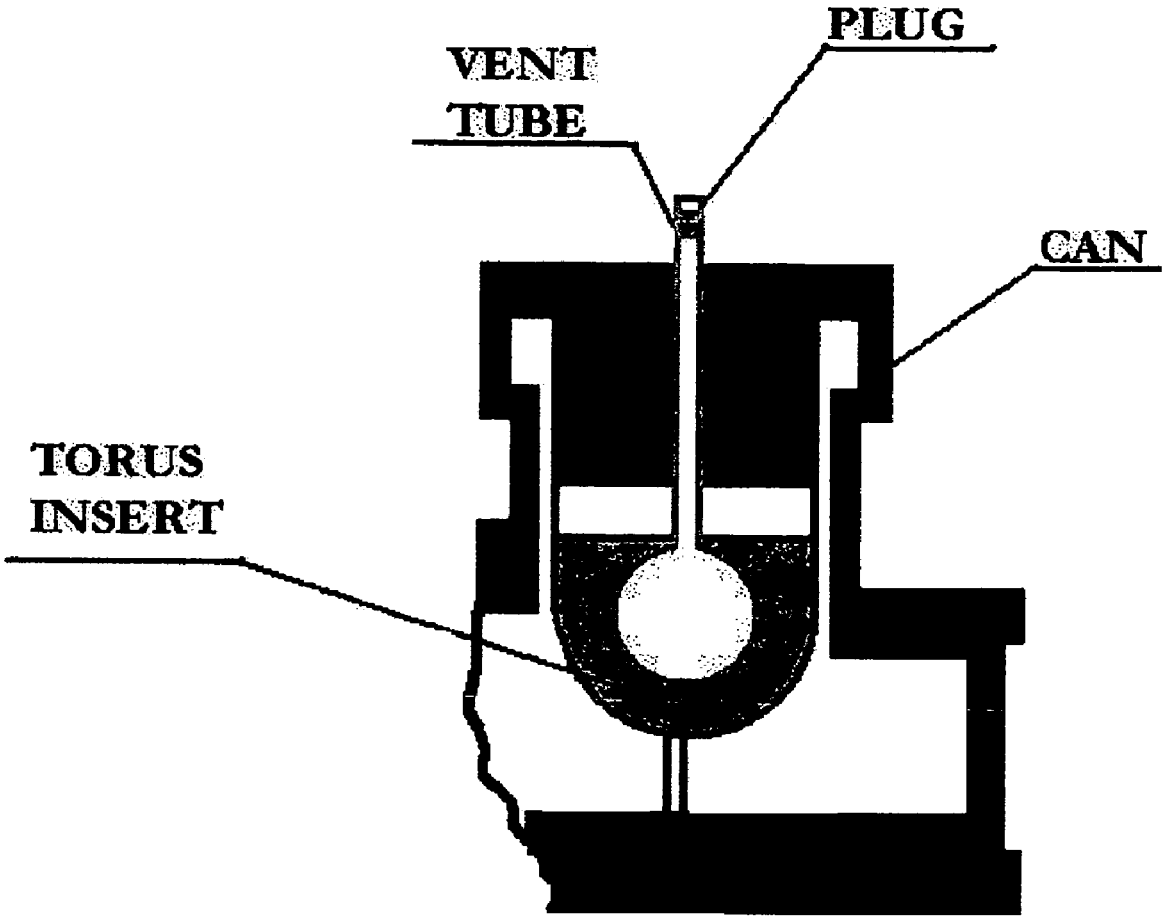
FIG. 5 shows pressure controlling UP tooling element comprising a vent tube mounted in the hollow insert. To prevent pressurization of the insert at the initial stage of HIP and its possible destruction the vent tube contained a plug.

FIG. 4 shows hollow toroidal multi-layer insert to provide cavities in the component. Hollow inserts were made as toruses consisting of the two layers. Tig welding was used to join the layers. FIG. 5 shows pressure controlling HIP tooling element comprising a vent tube. To provide venting of the hollow insert a vent tube was mounted in the hollow insert. To prevent pressurization of the insert at the initial stage of HIP and its possible destruction the vent tube contained a plug.

This method can be realized by three different controlled systems.

The first control system comprises a plug with the melting temperature below final HIP temperature, for example 0.5-0.9 of its value.

The second control system is a membrane, which destroys by the external pressure comprising 0.4-0.8 of the final HIP pressure.

The third control system is an interrupted HIP cycle, where during the first step the capsule filled with powder and comprising hollow inserts not connected to the atmosphere is HIPed below the final HIP temperature so that the pressure on the outer surface of the hollow inserts exceeds the current HIP pressure. The cavity in the hollow insert can be isolated from the atmosphere by putting a plug into the vent tube. It can be provided by the HIP pressure of 0.5-0.9 of the final HIP pressure when powder is compacted so that it transfers external pressure onto the external surface of the hollow inserts. It means that if at this stage the cavity in the hollow insert is connected to the HIP atmosphere the hollow insert will be in compression not in tension and will not be destroyed by introducing the HIP pressure.

When first HIP cycle is done at the pressure of 0.5-0.9 of the final HIP pressure, the said capsule is cooled and the cavity of the insert is connected to the atmosphere, for example by cutting the piece of the vent tube with the plug. Then the said capsule is HIPed to the final HIP temperature providing the HIP pressure inside the hollow inserts by injecting the HIP gas media through the vent tube into the cavity of the said inserts.

Other embodiment is a method wherein controlled pressure inside the HIP tooling is provided by installing inside the vent tube of a component part with the melting point below the final HIP temperature or by installing inside the vent tube of a membrane that has a collapse pressure below the final HIP temperature.

Other embodiment is a method wherein controlled pressure inside the HIP tooling is provided in three steps:

during the first step the said capsule filled with powder and comprising hollow inserts not connected to the atmosphere is HIPed below the final HIP temperature so that the pressure on the outer surface of the hollow inserts exceeds the current HIP pressure.

during the second step the said capsule is cooled and the cavity of the insert is connected to the atmosphere;

during the third step the said capsule is HIPed to the final HIP temperature providing the HIP pressure inside the hollow insert by injecting the HIP gas media into the cavity of the said inserts.

EXAMPLE 3

The example illustrates a method wherein controlled pressure inside the HIP tooling is produced in three steps:

Step 1. HIP tooling with Udimet 720 powder, was pressurized in the HIP furnace by 7 Ksi and then temperature was ramped to 1500 F and pressure-to 13 Ksi so that powder became ductile enough to transfer pressure onto the hollow insert;

Step 2. HIP tooling was cooled and de-pressurized and the plug of the vent tub was removed to provide venting of the hollow insert;

Step 3. HIP tooling was HiPed during the second cycle at 15 Ksi and 2050 F with this controlled pressure provided inside the hollow inserts of the tooling.

Other embodiment is a method to manufacture complex shaped large size structural parts including parts with cavities from powder materials by Hot Isostatic Pressing (HIP) with controlled pressure inside the HIP tooling and providing the shape of the part by multi-layer inserts comprising:

manufacturing of the shaping tool which includes a capsule having the internal shape and dimensions corresponding to the shape and dimensions of the final part;

manufacturing of the multi-layer inserts including hollow inserts to provide the shape and dimensions of the cavities in the part;

assembling of the said capsule with inserts;

filling the said capsule with powder material;

HIP of capsule with powder;

Control of pressure inside the HIP tooling;

Removal of the capsule and inserts;

EXAMPLE 4

The example demonstrates the following steps for manufacture of complex shaped large size structural component:

tooling parts fabricated from low carbon steel were carefully cleaned in fat removing solution and annealed in vacuum 10 mkm, under temperature 1900 F during 4 hours;

a capsule (can) was assembled from tooling elements including thin wall shells, multi-layer inserts to form the internal cavities of the part and webs of different thickness toroidal inserts with vent tubes to form manifolds;

after assembling, capsule elements were joined by argon welding:

Helium leak test was provided to check the quality of welding;

a capsule was filled with Udimet 720 powder under vacuum;

then capsule was hot outgassed to remove absorbed air, argon and moisture under vacuum 1-5 mkm and temperature 250 F to leak up rate 10 mkm/min;

a capsule was crimped and sealed under vacuum;

then a capsule filled with powder was HIPed under regimes depending on the design of HIP tooling element controlling the pressure.

After the third step HiPed capsule that formed desirable design (for example, FIG. 1) was pre-machined to remove available mild steel tooling and then pickled in acid to remove inserts and mild steel tooling totally.

One and more embodiments of the present invention are systems of manufacturing complex shape parts with cavities from powder materials by HIP with controlled pressure inside the HIP tooling and providing the shape of the part by multi-layer inserts comprising:

the shaping tool which includes a capsule having the internal shape and dimensions corresponding to the shape and dimensions of the final part;

multi-layer inserts including hollow inserts providing the shape and dimensions of the cavities in the part;

powder material;

HIP tooling element controlling the pressure inside said hollow inserts comprising a vent tube;

HIP tooling element controlling the pressure inside said hollow inserts is made as a membrane with collapse pressure below final HIP pressure or has a melting temperature below the final HIP temperature.

Other embodiment is a method for manufacturing complex shape parts including parts with cavities from powder materials by the HIP with subsequent simultaneous removal of the outer capsule and inserts by acid pickling provided by the hollow inserts connected to the atmosphere.

Due to the vent tube and hollow insert—acid can penetrate deep into the body of the part to intensify tooling removal process.

We claim:

1. A method for manufacturing complex shape parts with cavities from powder metal materials by Hot Isostatic Pressing (HIP), the method comprising:

a) providing a shaping tool including a capsule having internal shape and dimensions corresponding to desired shape and dimensions of a complex shape part;

b) providing hollow inserts having cavities corresponding to desired shape and dimensions of said cavities of said complex shape parts, and including a vent tube capable of controlling pressure inside said inserts;

c) assembling the capsule and the inserts and filling the capsule with powder;

d) performing an HIP step on the powder at a temperature below a final HIP temperature for the powder material while the cavities of the inserts are isolated from the HIP atmosphere and so that the pressure on the outer surface of the inserts exceeds the HIP pressure;

e) connecting the cavity of the inserts to the HIP atmosphere through the vent tube;

f) performing an HIP step on the powder at a final HIP temperature and pressure by injecting HIP gas media through the vent tube and into the cavity of the inserts;

g) removing the capsule and the inserts.

2. A method in accordance with claim 1, wherein said connection of the cavity of the inserts to the HIP atmosphere is performed by cooling the capsule and opening said vent tube.

3. A method in accordance with claim 1, wherein said connection of the cavity of the inserts to the HIP atmosphere is performed by perforating a membrane installed inside said vent tube at a pressure below the final HIP pressure.

4. A method in accordance with claim 1, wherein said connection of the cavity of the inserts to the HIP atmosphere is performed by melting a plug installed inside said vent tube at a temperature below the final HIP temperature.

* * * * *